United States Patent [19]

Adams

[11] Patent Number: 4,606,555

[45] Date of Patent: Aug. 19, 1986

[54] DIET CONTROL DEVICE AND METHOD

[76] Inventor: Florence Adams, 25 Hastings Rd., Old Bridge, N.J. 08857

[21] Appl. No.: 664,839

[22] Filed: Oct. 25, 1984

[51] Int. Cl.[4] ..... B42D 15/00

[52] U.S. Cl. ..... 283/52; 281/15 R; 434/127

[58] Field of Search ..... 281/15 R, 15 A, 15 B; 283/48 A, 52, 56; 434/127

[56] References Cited

U.S. PATENT DOCUMENTS

| | | | |
|---|---|---|---|
| 1,138,636 | 5/1915 | Davis | 283/52 X |
| 1,522,270 | 1/1925 | Ringler | 283/48 A |
| 1,713,241 | 5/1929 | Rice | 283/52 |
| 1,839,845 | 1/1932 | Greenbaum | 206/103 |
| 1,839,846 | 1/1932 | Greenbaum | 206/103 |
| 2,254,545 | 9/1941 | Roberts | 206/103 |
| 3,195,813 | 7/1965 | Hart | 434/127 X |
| 3,681,857 | 8/1972 | Yardley | 434/127 X |

*Primary Examiner*—Paul A. Bell
*Attorney, Agent, or Firm*—Ezra Sutton

[57] ABSTRACT

There is provided a diet control device and method for use by a dieter in administering a diet plan of particular food items which includes a booklet having a first cover, a second cover foldable relative to the first cover, and a plurality of cards attached to one of the covers, with each card being marked to represent a different day in the diet plan. Each of the cards includes a plurality of slits to form a plurality of individually removable and disposable tabs or splints. Each of the tabs or splints is detachably connected to one of the cards and is marked with predetermined diet information. In use, one or more tabs or splints are adapted to be removed from the booklet when the dieter has selected a particular food item within the diet plan.

6 Claims, 4 Drawing Figures

FIG. 3
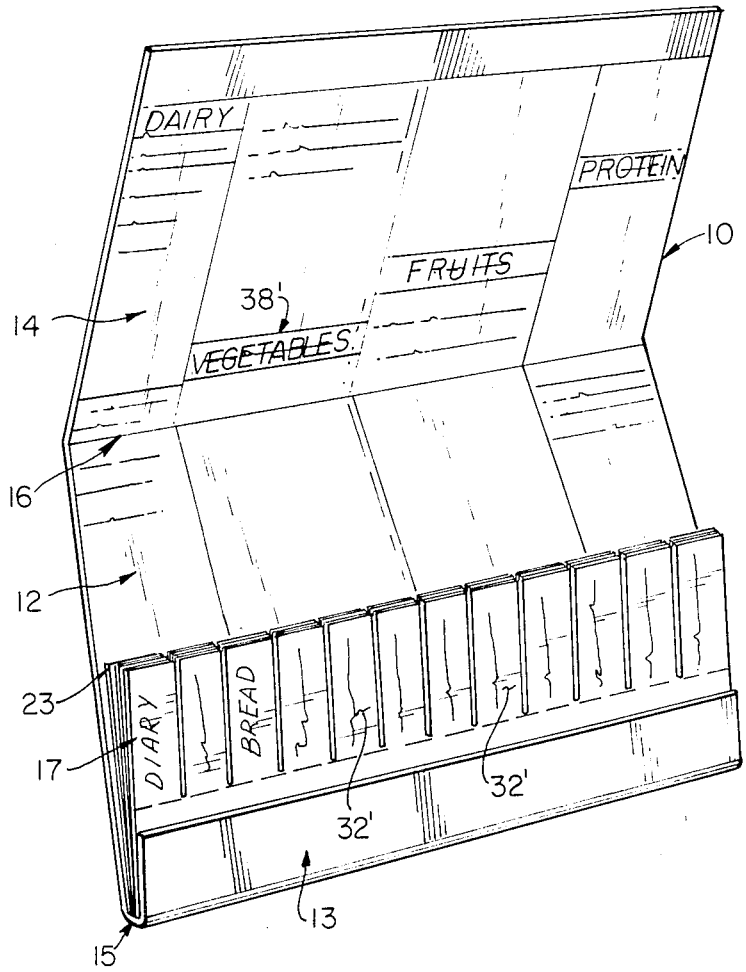
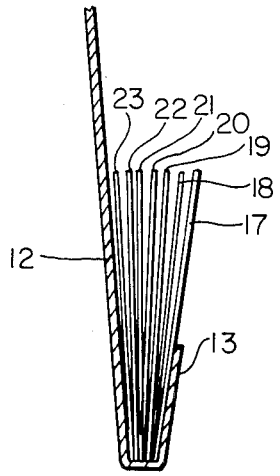
FIG. 4

DIET CONTROL DEVICE AND METHOD

FIELD OF THE INVENTION

The present invention relates to a novel diet control device and method for use by a dieter in administering a diet plan of particular food items, which device is simple and efficient to use, is inexpensive to manufacture, and is conveniently carried by the dieter.

BACKGROUND OF THE INVENTION

Although a great deal of material has been written on a proliferation of diet plans, an insufficient amount of research and development has been devoted to devices for administering the many diet plans which are available. Typically, the dieter must resort to carrying around a chart or list of the appropriate foods that can be eaten at each meal, and the dieter is left with the inconvenient and time-consuming task of calculating the amount of calorie intake at each meal, and keeping records of same during the course of a day. In some cases, the dieter must resort to using a number of aids in administering the diet plan, including a notebook, writing implements, a calculator, as well as a chart or list containing the necessary diet information.

Although some effort has been made in the prior art with regard to devices for administering diet plans, they have not been totally satisfactory, and in most cases are cumbersome, time consuming, and inconvenient to administer. This applies to the diet devices disclosed in U.S. Pat. No. 3,195,813, as well as U.S. Pat. No. 3,681,857, and U.S. Pat. No. 4,310,316.

Broadly, it is an object of the present invention to provide an improved diet control device and method which overcomes the aforesaid drawbacks. Specifically, it is within the contemplation of the present invention to provide a diet control device which is easy to administer, convenient to carry with the dieter, and simple and inexpensive to manufacture.

It is a further object of the present invention to provide a diet control device and method which is simple to follow and provides the advantage of allowing the dieter to easily and conveniently administer the diet plan.

SUMMARY OF THE INVENTION

Briefly, in accordance with the principles of the present invention, there is provided a diet control device for use by a dieter in administering a diet plan of particular food items which includes a booklet having a first cover, a second cover foldable relative to the first cover, and a plurality of cards attached to one of the covers, with each card being marked to represent a different day in the diet plan. In addition, each of the cards includes a plurality of slits to form a plurality of individually removable and disposable tabs or splints. In accordance with the invention, each of the tabs or splints is detachably connected to one of the cards and is marked with predetermined diet information. The information includes either the number of grams of a particular food item, or the number of calories of a particular food item, or just the particular food item which may be selected by the dieter. In use, one or more tabs or splints are adapted to be removed from the booklet when the dieter has selected a particular food item within the diet plan.

Advantageously, as a result of the present invention, a simple and inexpensive device is provided for use by a dieter in administering a diet plan consisting of particular food items. The diet control device, in the form of a booklet, is all that the dieter need have to administer a diet plan. All calculations and entries to be made by the dieter have been eliminated by the diet control device of the present invention, as it is only necessary for the dieter to merely detach and dispose of one or more of the tabs each time a particular food item is selected. At any time during the course of a day, the dieter only has to look at the card for that particular day to see if any tabs are remaining, to know which ones have not been used. The dieter then knows how many more food items are within the limitations of the particular diet plan.

As the tabs within the booklet are prerecorded with all of the necessary information, and have been precalculated to total the amount of calories or grams for that particular day, administration of the diet plan becomes simple and efficient, and thereby more conducive to the dieter continuing with the diet plan on a long-term basis.

The booklets can contain either seven cards which would be sufficient for a week, or a total or thirty cards which would be sufficient for administering the diet plan for a month. When the booklet has been completely used, it is only necessary for the dieter to obtain another booklet to continue with administering the diet plan.

Further objects, features, and advantages of the present invention will become apparent upon the consideration of the detailed description of the presently preferred embodiments when taken in conjunction with the accompanying drawings, wherein:

FIG. 3 is a perspective view of an alternative embodiment wherein the tabs or splints have different diet information printed thereon, and FIG. 4 is a cross-sectional view of the booklet showing the various cards attached thereto.

DETAILED DESCRIPTION OF THE PREFERRED EMBODIMENTS

Figure 1:
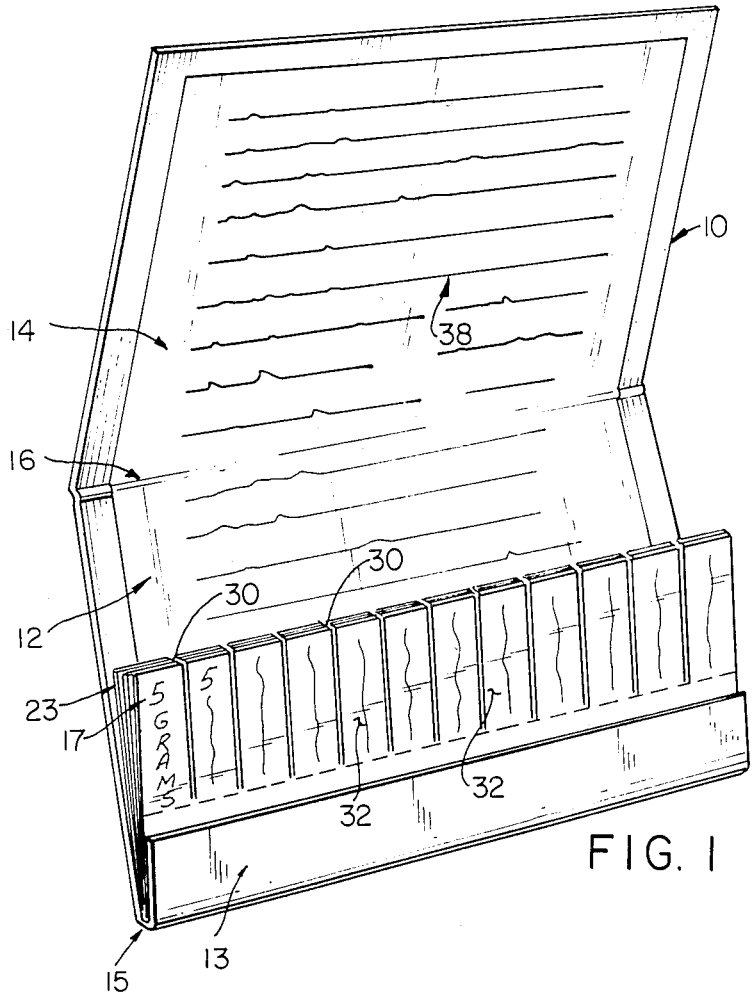
FIG. 1 is a perspective view of a booklet in accordance with the present invention.

Referring to the drawings, the booklet in accordance with the present invention is shown at 10 in FIG. 1, and includes a first cover 12, and a second cover 14, which are foldable relative to each other about a hinge line 16. The booklet and covers are formed of any suitable material, such as cardboard, plastic, or the like. A plurality of seven cards, 17, 18, 19, 20, 21, 22, 23, are attached to the cover 12 by any suitable means, such as adhesive 26, staples, or the like. As shown most clearly in FIG. 2, the lower portion of cover 12 is folded over at 13 to form a pocket 15 for receiving the plurality of cards 17 to 23.

Figure 2:
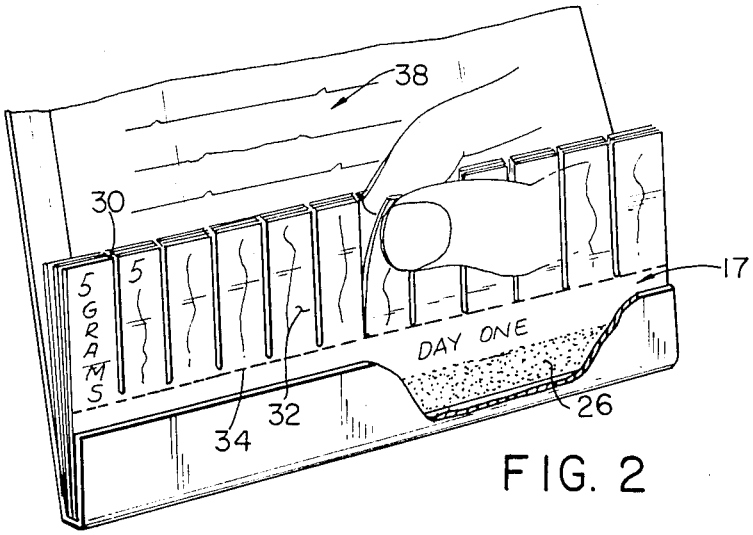
FIG. 2 is another perspective view showing one of the tabs or splints being removed from the booklet.

As shown in FIG. 2, card 17 is marked to represent day 1, and each of the succeeding cards is marked to represent a succeeding day in the diet plan covering a total of one week. Of course, it is within the scope of the present invention that the number of cards can be increased or decreased, as desired. For example, booklets 10 can include fourteen cards for a two-week diet plan, or alternatively, thirty cards for administering a diet plan for one month.

In addition, as shown in FIGS. 1 and 2, each of the cards 17 through 23 includes a plurality of slits 30 to form a plurality of individually removable and disposable tabs or splints 32. Each of the tabs 32 are detachably connected along perforations 34, so that each tab 32 can easily be detached from each card and discarded after it is used. In the preferred embodiment, the cards are formed of cardboard or paperboard.

As seen in FIGS. 1 and 2, each of the tabs 32 is marked with predetermined diet information. For example, in this particular embodiment, each tab 32 contains the statement "Five grams". In addition, the covers 14 and 16 have information related to the diet plan printed thereon, such as a listing of particular foods, and their portions which total five or ten grams. For example, information 38 printed on the inside surfaces of the covers would state as follows: bean sprouts, one cup, five grams, or, broccoli, one stalk, five grams. In this manner, prerecorded information 38 corresponds in multiples of five grams to the five grams indicia printed on each of the tabs 32.

In use, on day one, for example, the dieter opens the booklet 10 and reviews the information 38 printed on the inner surfaces of covers 12 and 14. The dieter selects one or more food items to be consumed at that meal, and takes note of the number of grams for each of the selected food items. For example, if the dieter selects two food items at five grams each, and one food item at ten grams, the dieter would then remove four of the tabs 32 to total the twenty grams which have been selected. At the next meal or snack, the same process is repeated. When the dieter notes that there are no longer any tabs left for that day, the dieter knows that he or she has consumed the maximum amount of allowable grams for that day. However, at any point during the course of the day, the dieter need only review the remaining number of tabs 32 in order to determine the remaining number of food items or portions which can be selected for that day.

In this manner, as a result of the present invention, all calculations, record-keeping, notebooks for record keeping, etc. are eliminated. Instead, the diet control device of the present invention allows the dieter to automatically adminster and follow a diet plan consisting of particular food items, without any entries or records being made by the dieter to administer the diet plan.

Turning now to FIG. 3, there is shown an alternative embodiment of the present invention which also employs a booklet 10, and wherein corresponding reference numerals refer to the same elements as discussed with regard to FIGS. 1 and 2. However, in this embodiment, the pre-recorded information 38′ on the inner surfaces of the cards 12 and 14 is different from that shown in FIGS. 1 and 2, and in addition, the precorded information on tabs 32′ is also different from the information contained on tabs 32 in FIGS. 1 and 2. More particularly, in this embodiment, each of the tabs 32′ contains the listing of a different category of food products such as dairy, bread, vegetable, fruit, protein, or fats. These designations on tabs 32′ correspond to categories of food products printed at 38′. The same headings—dairy, bread, vegetable, fruit, etc.—are printed on the inner surfaces of cards 12 and 14, and under each heading a number of food items are listed with appropriate portions.

In use, for a particular meal, the dieter may select, for example, one fruit, one vegetable, and one protein. In such a case, the dieter selects and removes three of the tabs 32′ containing these designations.

The process is repeated during the course of a day until all of the tabs 32′ for that particular day have been selected and removed. At that point, the dieter knows that he or she has consumed the maximum allowable calories for the day, in accordance with the diet plan selected.

In accordance with the present invention, it should be understood that the number of tabs for a particular day can be varied in accordance with a particular diet plan and, in addition, the particular food categories and food products can also be modified to meet the characteristics of a particular diet plan. Further, instead of printing the number of grams on a particular tab, the number of calories of a particular food item could also be printed. Still further, the cards and tabs 32 and 32′ can be formed of any suitable material, such as paper, cardboard, or any other material which is easily detachable and also disposable.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A diet control device for use by a dieter in administering a diet plan of particular food items, comprising:
   - a booklet having a first cover and a second cover foldable relative to each other;
   - at least one of said first and second covers having printed thereon predetermined information relating to the food items in said diet plan;
   - at least seven cards attached to said first cover, each card being marked to represent a different day in the diet plan;
   - each of said cards including a plurality of slits to form a plurality of individually removable and disposable tabs;
   - each of said tabs being detachably connected to one of said cards and being marked with predetermined diet information; and
   - said tabs adapted to be removed from said booklet when the dieter selects a particular food item to be consumed within the diet plan.

2. A device according to claim 1, wherein the predetermined diet information on each tab includes the number of grams corresponding to a particular food item.

3. A device according to claim 1 wherein the predetermined diet information on each tab includes the number of calories corresponding to a particular food item.

4. A device according to claim 1 wherein the predetermined diet information on each tab identifies a particular food item.

5. A device according to claim 1 wherein each of said cards is formed of cardboard material.

6. A device according to claim 1 wherein each of said cards and tabs is formed of paper.

* * * * *